US009289777B2

(12) United States Patent
Thalberg et al.

(10) Patent No.: US 9,289,777 B2
(45) Date of Patent: Mar. 22, 2016

(54) PULSED INDUCTION SYSTEM FOR FLUIDS TO A COMBUSTION CHAMBER

(75) Inventors: Anders Thalberg, Hafslunsoy (NO); Steinar Slette, Hamar (NO)

(73) Assignee: CARBON REDUCTION SOLUTIONS AS, Gralum, Sarpsborg (NO)

( * ) Notice: Subject to any disclaimer, the term of this patent is extended or adjusted under 35 U.S.C. 154(b) by 717 days.

(21) Appl. No.: 13/404,110

(22) Filed: Feb. 24, 2012

(65) Prior Publication Data

US 2012/0217190 A1 Aug. 30, 2012

Related U.S. Application Data

(60) Provisional application No. 61/450,713, filed on Mar. 9, 2011.

(30) Foreign Application Priority Data

Feb. 24, 2011 (NO) ..... 20110308

(51) Int. Cl.
*F02M 27/04* (2006.01)
*B03C 1/32* (2006.01)
(Continued)

(52) U.S. Cl.
CPC ..... *B03C 1/0335* (2013.01); *B03C 1/32* (2013.01); *F02M 27/04* (2013.01); *B03C 2201/22* (2013.01); *B03C 2201/30* (2013.01); *F02M 2027/047* (2013.01)

(58) Field of Classification Search
CPC ..... B03C 1/035; B03C 1/0355; B03C 1/30; B03C 1/32; B03C 2201/30; B03C 1/0335; B03C 2201/22; F02M 27/00; F02M 27/04; F02M 27/045; F02M 2027/047; C02F 1/48; C02F 1/484; C02F 1/485; C02F 1/487; C02F 2201/48; C02F 2201/483; F02B 51/04
USPC ..... 210/222, 223, 695, 97, 141, 142; 204/554, 555, 556, 557, 660, 661, 663, 204/664; 96/1–2; 95/28; 123/1 R, 1 A, 536, 123/537, 538, 539
See application file for complete search history.

(56) References Cited

U.S. PATENT DOCUMENTS 2,664,394 A * 12/1953 Reeves ..... C07C 2/00 204/155
4,308,847 A * 1/1982 Ruizzo, Jr. ..... F01M 13/022 123/536

(Continued)

FOREIGN PATENT DOCUMENTS

DE 4229594 A1 * 3/1994
GB 2442011 A * 3/2008

(Continued)

OTHER PUBLICATIONS

English language machine translation of DE 4229594 A1, created Apr. 28, 2015.*

*Primary Examiner* — David C Mellon
(74) *Attorney, Agent, or Firm* — Young & Thompson

(57) ABSTRACT

An apparatus for magnetic pre-treating of a first or second flow of fluid (11, 12) in one supply pipe (1, 1") to a combustion chamber (6), wherein at least one magnetic field (22) is extended through said flow of fluid (11, 12) passing through said supply pipe (1, 1"), wherein said magnetic field (22) is induced by at least one electromagnet (2) each said electro magnet comprising an electrical coil (21) provided with energy from a voltage source (3); with an electrical pulse generator (4) provided with voltage from said voltage source (3) and arranged to generate electrical pulses (p) with a desire frequency (f) to said electrical coil (21).

16 Claims, 4 Drawing Sheets

(51) Int. Cl.
*B03C 1/035* (2006.01)
*B03C 1/033* (2006.01)

(56) References Cited

U.S. PATENT DOCUMENTS 4,865,747 A * 9/1989 Larson ..... C02F 1/487 210/222
5,074,998 A * 12/1991 De Baat Doelman ..... 210/97
5,122,277 A * 6/1992 Jones ..... C02F 1/481 210/222
5,171,431 A * 12/1992 Schulte ..... 210/94
5,517,975 A * 5/1996 Iwata ..... F02M 27/04 123/538
5,829,420 A * 11/1998 Kita ..... F02M 27/04 123/538
7,650,877 B2 1/2010 Thalberg et al.
2011/0168607 A1 * 7/2011 Ries ..... B03C 1/24 209/212

FOREIGN PATENT DOCUMENTS

NO 316089 12/2003
NO 329826 12/2010

* cited by examiner

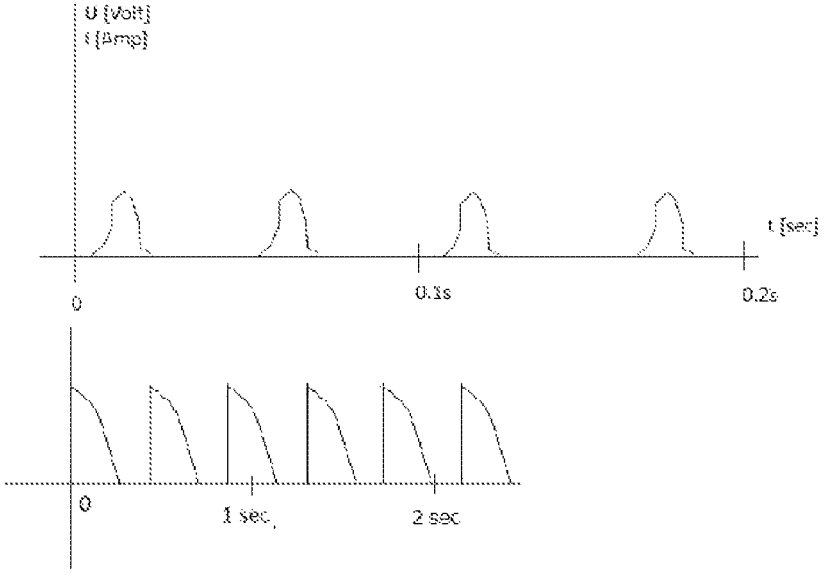
Fig. 3: two examples of pulses with the same polarity

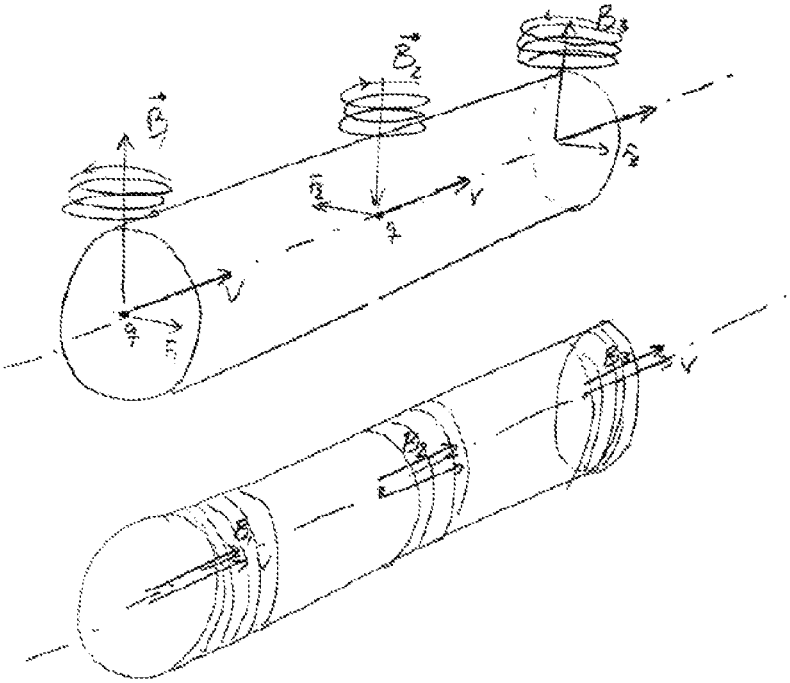
Fig. 4: along directed magnetic field (bottom, prior art) and cross-directed induced magnetic field (top) according to the invention.

PULSED INDUCTION SYSTEM FOR FLUIDS TO A COMBUSTION CHAMBER

INTRODUCTION

The invention is an electromagnetic device for pre-treating flow of fluids such as air and fuel prior to combustion in an internal combustion engine such as a piston engine or a gas turbine to increase efficiency while unwanted or harmful environmental emissions are reduced.

GENERAL BACKGROUND

Attempts to influence and improve the combustion processes by exposing the combustion process or supply lines, for a magnetic field, has been ongoing at least since about the 1960s. Installation of the magnets to prevent iron filings from engine production to get into aircraft engines have been used during World War II.

INTRODUCTION TO PROBLEMS TO BE SOLVED

It is believed that magnetic fields may improve combustion processes by magnetically influencing the fluids that run into the combustion process, even if the applicant knows no full scientific explanation of such electromagnetic pretreatment of fluids would work. It is through practical testing and isolated experiments that the applicant has been able to develop practical magnetic devices designed for this purpose, see e.g. NO316089, U.S. Pat. No. 7,650,877, NO329826.

IN GENERAL

In prior art systems for magnetic pretreatment of fuel or combustion air permanent magnets are used. These may also be made as electromagnets, but it takes a lot of electric current in order to generate a magnetic field corresponding to the field from a permanent magnet. Permanent magnets based on neodymium are very strong. This makes the work on the assembly line difficult because of the magnetic forces induced on everything in the vicinity that may be magnetized by permanent magnets in the process. When these permanent magnets are mounted on large engines, where the magnets are to be scaled relative to the size of the fluid flow, one will quickly end up with magnets of a strength that may be dangerous to work with because one may risk damage by crushing.

On some systems, it is also not very advisable to mount heavy permanent magnets because the weight of the magnets will provide long-term damage to the air and fuel pipe and thus it would mean that one would have to reinforce the structures to an undesirable extent.

Presently, the applicant uses several permanent magnets mounted in sequence on fluid supply pipes to achieve enhanced effects on engines and combustion facilities. The device according to the present invention occupies less space than the one used in prior art, and also weigh less.

The present system works dynamically, so that it better works by variations of the liquid and gas velocities in a given engine or turbine system. Strong permanent magnets are made of rare earth metals, is a limited resource. An electromagnetic system benefits from common electrical conductors such as copper or aluminum, and cores mainly of iron, and may thus be supplied in large volumes without the same restrictions one can risk when using rare earth metals.

BRIEF DESCRIPTION OF THE FIGURE

The reference numbers in FIGS. 1 and 2 are:

V—speed of fluid
1—inlet pipe for fluid
2—electro magnet
3—power source
4—pulse generator
5—polarity control device
5' —polarity control device
6—combustion engine
11—fluid flow
12—fluid flow
21—electrical coil
22—magnetic fields
41—control unit (for example: comprised in CPU)
42—control signals
45—control signal for polarity control device
61—combustion chamber
62—sensor
63—sensor signals
u(t1)—a volume of fluid at t1
u(t2)—a volume of fluid at t2
u(t3)—a volume of fluid at t3

FIG. 3 shows two examples of the pulse train of magnetic pulses or the voltage pulses of an electromagnet that generates magnetic pulses.

FIG. 4 shows longitudinally directed magnetic field in the lower part of the drawing according to prior art, and cross-oriented induced magnetic field in the top part of the drawing according to the present invention.

DESCRIPTION OF EMBODIMENTS OF THE PRESENT INVENTION

Figure 1:
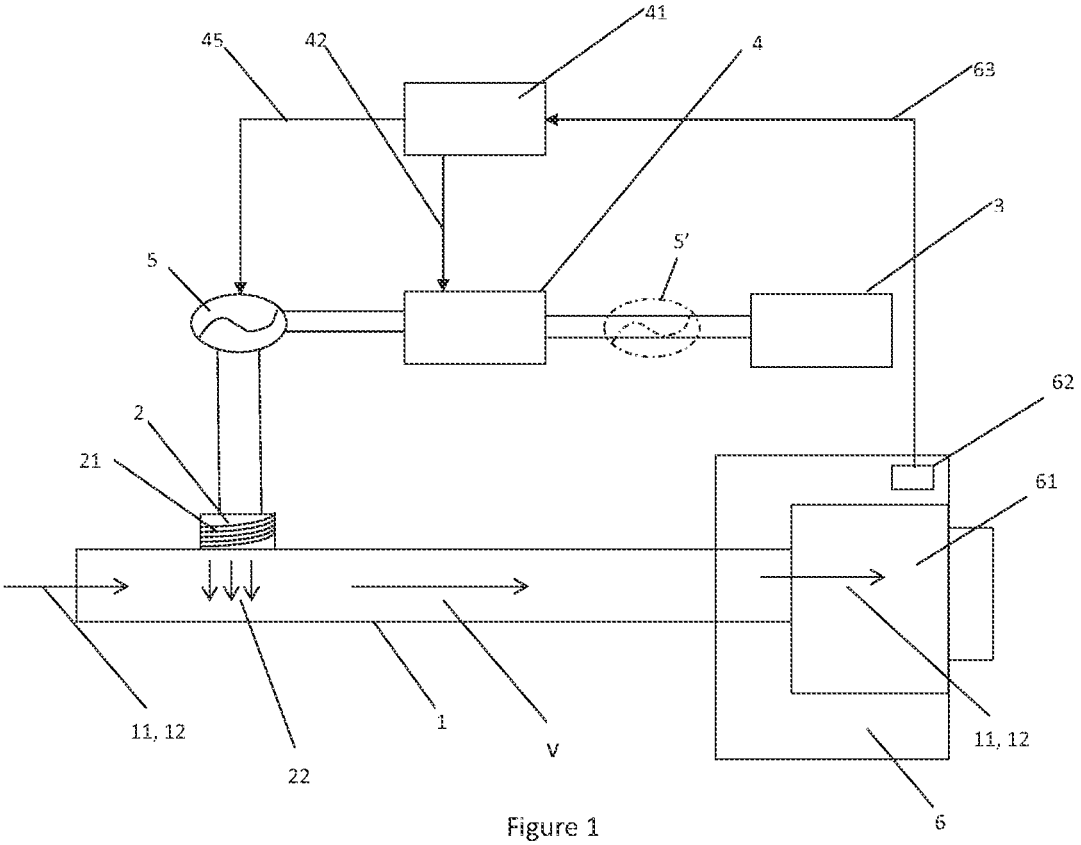
FIG. 1 is a principal drawing of a single electromagnet used in the invention and which illustrates a longitudinal section of a pipe for fluids (e.g. Air or fuel or a mixture thereof) with an electromagnet arranged to generate a magnetic field perpendicular to the flow of fluid in the pipe and a pulse generator arranged to form a current pulse through the electromagnet. The pulse generator has a voltage source and it is also arranged a switch to form the desired direction of the current flow and thus the magnetic field.

The present invention will be described below in various embodiments. The present invention is illustrated in an apparatus for magnetic pre-treatment of a first or second flow of fluid (11, 12) in a supply pipe (1, 1') wherein the fluid flow runs to a combustion chamber (61). The first fluid flow may be a fuel flow (11) and the second fluid flow may be an air flow (12). At least two magnetic fields (22) are led through the fluid flow (11, 12) which runs through the supply pipe (1, 1'), see FIG. 2.

Each magnetic field (22) may have an arbitrary direction through the fluid flow (11, 12) and just run through a cross sectional or longitudinal part of the fluid flow. One example of this is that the magnetic field (22) runs generally transversely a small section of a supply pipe (1, 1') that guides a fluid flow, whether it is the air flow or the fuel flow.

In a preferred embodiment of the inventor the magnetic fields are formed as transverse field relative to the axis of the supply pipe (1, 1'). This has several advantages.

We assume that the fluid or gas contains charged particles, which one to a certain degree will experience for fluids or gases that moves in synthetic insulating pipes. If one allow the charged particles to run along the pipe and having a magnetic field that runs transversely of the tube, each particle will experience a force that is perpendicular to the pipe axis and perpendicular to the magnetic field, according to the vector formula $F=q\ v\times B$. The greater the angle between v and B is, the greater the F will be. This suggests that the magnetic field should be transversely the general flow in the pipe, see FIG. 4, and a preferred embodiment with two or more electromagnetic coils in FIG. 2. It shall, according to the invention, be two or more separated magnetic fields, and it shall also, in a preferred embodiment, be at least a defined distance between the sources of the fields, i.e. the electro-magnets 2.

One do not merely want to expose the fluid/gas for a single magnetic field, but to do this with the magnetic field lines that affect the fluid/gas with a field vector that is transversely arranged to the fluid/gas direction of movement, and at the same time repeat the treatment with an equally strong and opposite directed field, at least two in sequence, preferably three or more.

Experiments show that the transversely arranged fields provide the best and fastest results as one achieve an improvement of the air/fuel mixture combustion capability when it reaches the combustion chamber, while longitudinal fields are bound to influence more than just fluid/gas since it generates a magnetic field in the longitudinal metal components that are arranged upstream and downstream of the position of the magnetic field. Axial fields are quickly influenced by highly permeable metals. The "DC-field" of the magnetic field will arrange itself along and within the high permeability metals such as steel, leaving a relatively weak field in the center of the pipe where the gas or the fluid is located, if the electromagnet is arranged parallel to the axis of the pipe. An alternating field will generate undesired ring current in the metal pipe wall, causing an energy loss, if it is made of or comprises electrically conductive material such as steel or steel armor or copper pipe or aluminum pipe, or iron-particle-containing contamination in an otherwise insulating plastic pipe.

A transversely arranged magnetic field will break through a metallic pipe wall and influence or magnetize a much smaller area of metal pipe wall than a longitudinal directed magnetic field.

The magnetic field 22 is induced in each location of the at least one electromagnet 2 comprising an electrical coil 21 receiving energy from a voltage source 3. An electric pulse generator 4 is supplied with power from the power source 3 and is arranged to generate electrical pulses P of desired frequency f to the electric coil 21.

Figure 2:
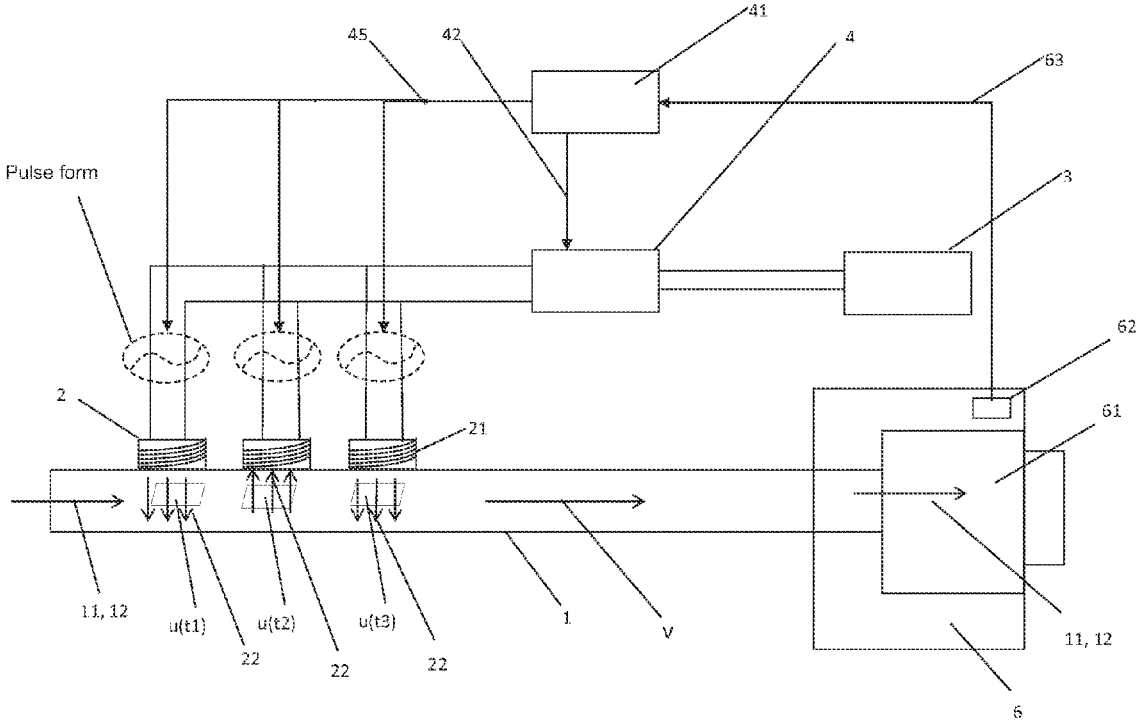
FIG. 2 illustrates an embodiment of the invention shown in FIG. 1 where it is arranged two or more electromagnets on the supply pipe, here three electromagnets.

The device according to the invention has in one embodiment a polarity control device 5 for the electrical pulses P wherein the polarity control device is arranged between pulse generator 4 and the electric coil 21, as illustrated in FIG. 2.

The device according to the invention may be arranged so that the polarity control device 5 for the electrical pulses P is arranged to provide a time delay or phase displacement of the electrical pulses P such that one in this way may control the polarity of the pulses if the pulses are parts of a pulse train with varying polarity as a function of time.

The device according to another embodiment of the invention may be arranged such that a polarity control device 5' for the electrical pulses P is arranged between the pulse generator 4 and the power source 3, as indicated by the dotted lines 5' in FIG. 1.

The device according to one embodiment of the invention has a control unit 41 that regulates the electrical pulses P to be generated in the pulse generator 4. The control unit 41 is arranged to send control signals 42 on the basis of sensor signals 63 from at least one sensor 62 in the combustion engine 6. These control signals 42 determine the electrical pulses) form, voltage, amperage, frequency, or pulse pattern, and also their polarity. These sensor signals 63 as the control unit 41 will act on the basis of can for example be one or more of the following parameters:

The engine rotation speed,

Air temperature,

Air flow running through the supply pipe 1 per unit of time;

Air velocity of the inlet air in the supply pipe;

Amount of fuel running through the fuel supply pipe 1' per unit of time;

Fuel temperature before the inlet to the combustion chamber;

Fuel speed in the fuel supply pipe;

The device according to one embodiment of the invention may be arranged so that the control signals 45 from the control unit 41 also control the polarity control device 5.

One may imagine that other devices, where a continuous flame shall be formed, such as pan heaters (which has no RPM) or turbines, other parameters may be used as input parameters to the control system which controls the pulses to electro magnets.

Since the velocities in the fuel line and inlet air pipe will be different, it will in one embodiment of the invention be generated different pulse speeds in the electric magnets that affect the two lines/pipes separately.

The number of electromagnets 2 in an embodiment of the invention is two or more as shown in FIG. 2. The coil of electro magnet 21 may be arranged on the outside surface of the supply pipe 1, 1', inside the pipe 1, 1' or inside the pipe wall of the pipe 1, 1'.

As mentioned above, at least one of magnetic fields 22 may run mainly transversely of at least one of the fluid flows of air or fuel 11, 12 inside the air pipe or fuel pipe 1, 1'.

The device according to the invention may have two or more electro-magnets 2 arranged with a mutual distance along the flow direction of the fluid flow 11, 12. The distance between two electromagnets may for example be as large as the diameter or length of each electro-magnet. It is possible to mount the electro magnets so that they generate their magnetic field transversely of the flow in the pipe, but that a subsequent magnet forms a magnetic field which is rotated slightly, for example between 5 and 30 degrees relative to the magnetic field of present magnet. The frequency f of the electrical pulses P may be adapted relative to the speed of fluid flow 11, 12 so that a fluid volume u which is exposed to an electromagnets 2 pulse P at a first point of time t1 will move with a velocity v to a next electromagnet 2 and is affected by a pulse P from this next electromagnet. This may be repeated for one or more additional electromagnets. According to an embodiment of the invention the above mentioned repeated pulses P which a fluid volume u is exposed to along its path, may have different directions relative to each other, for example, every second polarity opposite. In this way, short pulses can be made stronger than a continuous induced magnetic field, which will save a lot of power and thus a lot of energy, and which thereby can reduce fuel consumption used for this purpose.

It is the inventor's experience that magnetic influencing of the fluid 11, 12 should be made elsewhere relative to the parts of the supply pipe 1, 1' where turbulence, eddies or unwanted pressure pulsations in the pipe are formed. The electromagnet 2 according to the invention is therefore, according to an embodiment of the invention, arranged elsewhere, preferably downstream relative to any such eddies, turbulence-forming regions or pressure pulse formations in the fluid flow 11, 12 in the tube (1, 1').

The device according to the invention may be for pre-treatment of fluids for a combustion chamber 61 that may be open in one end, e.g. as part of a flare.

The device according to the invention may be for pre-treatment of fluids for the combustion chamber 61 in a boiler 63.

The device according to the invention may be for pre-treatment of fluids for the combustion chamber 61 in a combustion engine 6 such as a gas turbine.

The device according to the invention may be for pre-treatment of fluids for one or more combustion chambers 61 in a combustion engine 6, which may be a piston engine.

The device according to the invention may be for the pre-treatment of a first fluid 11 which is fuel, such as heavy oil, light oil, gasoline, diesel, methane, or alcohol. Plant oils such as rapeseed oil may also be used. The second fluid 12 may be air, pure oxygen, nitrogen free air or other oxygen-containing gas.

Significant advantages of the invention are as follows that the device according to the invention allows, as opposed to the use of permanent magnets, control of the strength of the magnetic-pulses generated through the fluids 11, 12. It is possible to vary the magnetic field strength to strengths of the magnetic field that provides a near optimal increase in the efficiency of the combustion. Furthermore, it is possible to control the shape of the pulses P, and the frequency of the pulses P as shown in FIG. 3 in order to form shapes and frequencies of the pulses P, depending on the flow velocity, flow volume, speed, etc., for the process which is supplied with fuel.

Another advantage is that when one generate electrical pulses one may achieve strong magnetic fields in limited time frames, as shown in FIG. 3, without consuming much electrical energy compared to having an electro-magnet that consumes a lot of electrical energy by having a constant current which provides a constant strong magnetic field. An example of equivalent electrical pulses is the coil that supplies the spark plugs with high voltage pulses, but that consumes very little electric power. It is not known to use such coil systems for generating magnetic pulses through the fuel or combustion air lines, and if an existing coil system e.g. for supply of voltage to spark plugs in a gasoline engine is used to deliver electrical pulses to a system according to the invention, one has already a frequency control, which varies with RPM of the engine.

The invention claimed is:

1. An apparatus for magnetic pre-treating a first flow of fluid (11) or a second flow of fluid (12) in one or more supply pipes (1, 1') for air or fuel (12, 11) to a combustion chamber (61), comprising:

a voltage source (3);

a supply pipe (1, 1') through which a flow of fluid (11, 12) with a flow velocity flows in a first direction to the combustion chamber (61), the flow of fluid (11, 12) being one of the group consisting of the first flow of fluid (11) and the second flow of fluid (12);

at least two electromagnets (2) located on the supply pipe (1, 1') and arranged with mutual separations along the first direction, each said electromagnet (2) comprising an electrical coil (21) provided with energy from the voltage source (3), each said electromagnet (2) inducing a magnetic field (22) extending into the supply pipe (1, 1') and transversally through said fluid (11, 12), each said magnetic field (22) having a magnetic field reach in a direction transverse through said fluid (11, 12) that is opposite a transverse direction of an immediately adjacent one of said magnetic fields (22) such that the direction of said magnetic fields (22) alternate through said fluid (11, 12) from one magnetic field (22) to the immediately adjacent magnetic field (22);

an electrical pulse generator (4) provided with voltage from said voltage source (3), said electrical pulse generator (4) configured to generate electrical pulses (P) to said electrical coils (21), the generated electrical pulses (P) defining a pulse train of electrical pulses, each electrical pulse having a time duration;

a sensor (62) that senses the flow velocity of the fluid (11, 12) and produce sensor signals (63) relating to the flow velocity of the fluid (11, 12);

a control unit (41) operatively connected to said sensor (62) to receive the sensor signals (63) from said sensor (62), the control unit (41) utilizing the received sensor signals (63) to produce control signals (42) that control said pulse generator (4) and regulate the electrical pulses (P) to be generated in the pulse generator (4) to control and operate the electrical coil (21) of each said electromagnet (2) such that each electrical pulse of the pulse train causes the electrical coil (21) of a respective one of the electromagnets (2) to induce, during the time duration of each electrical pulse, a respective one of the magnetic fields (22) to encompass a first fluid volume (u) of the fluid, with the induced one magnetic field (22) collapsing at an end of the time duration of each electrical pulse, the produced control signals (42) being adjusted based on the flow velocity of the fluid (11, 12) as indicated by the produced sensor signals (63) of the sensor (62), and wherein the control unit (41) is programmed to provide the control signals (42) to the electrical pulse generator (4) to control the electrical pulse generator (4) to provide said electrical pulses (P) according to the flow velocity that the flow of fluid (11, 12) so that i) after a first electrical pulse of the pulse train causes the first fluid volume (u) to have been subjected to a first said magnetic field (22) from a first one of the electromagnets (2), the first said magnetic field (22) collapses and the first fluid volume then travels to the magnetic field reach of a subsequent adjacent, second one of the two or more electromagnets (2), and ii) a second electrical pulse of the pulse train is provided when the first fluid volume arrives at the magnetic field reach of the adjacent, second one of the electromagnets (2), the second electrical pulse causing the first fluid volume (u) to be subjected to a second said magnetic field (22) from the second one of the two or more electromagnets (2) during the time duration of the second electrical pulse.

2. The apparatus of claim 1, wherein a polarity control device (5) for said electrical pulses (P) is arranged between said pulse generator (4) and said electrical coils (21), said polarity control device (5) being operatively connected to the electrical pulse generator (4) and further operatively connected to and controlled by said control unit (41).

3. The apparatus according to claim 2, wherein said polarity control device (5) for said electrical pulses (P) is controlled by said control unit (41) to provide a time delay or phase change of said electrical pulses (P) in the pulse train based on the velocity of said flow of fluid (11, 12).

4. The apparatus according to claim 1, wherein a polarity control device (5') for the electrical pulses (P) is arranged between said pulse generator (4) and said voltage source (3).

5. The apparatus according to claim 1, wherein said control signals (42) determine said electrical pulses' (P) shape, voltage, current, frequency, or pulse pattern.

6. The apparatus according to claim 5, wherein said control signals (42) determine the polarity of said electrical pulses (P) and thus the direction of said magnetic field induced.

7. The apparatus according to claim 1, further comprising a polarity control device (5) configured to provide a time delay or a phase change of said electrical pulses (P), and wherein further control signals (45) from said control unit (41) control said polarity control unit (5).

8. The apparatus according to claim 1, wherein said two or more electromagnet's coils (21) are arranged on an outside surface on said supply pipe (1, 1').

9. The apparatus according to claim 1, wherein said electromagnets (2) are arranged downstream relative to eddies formed in said flow of fluid (11, 12) in said supply pipe (1, 1').

10. The apparatus according to claim 1, wherein said combustion chamber (61) is in a combustion engine (6) which is a piston engine.

11. The apparatus according to claim 1, wherein the flow of fluid (11, 12) is the first flow of fluid (11), the first flow of fluid (11) is a fuel flow (11), and the sensor signals (63) relate to the flow velocity as an amount of the fuel running through the supply pipe per unit of time.

12. The apparatus according to claim 11, wherein said at least two electromagnets (2) located on the supply pipe (1, 1') and arranged with mutual separations along the first direction, comprise three electromagnets (2).

13. The apparatus according to claim 1, wherein the flow of fluid (11, 12) is the second flow of fluid (12), the second flow of fluid (12) is an air flow (11), and the sensor signals (63) relate to the flow velocity as an amount of the air flow running through the supply pipe per unit of time.

14. The apparatus according to claim 13, wherein said at least two electromagnets (2) located on the supply pipe (1, 1') and arranged with mutual separations along the first direction, comprise three electromagnets (2).

15. The apparatus according to claim 1, wherein said control signals (42) determine said electrical pulses' (P) pulse pattern.

16. The apparatus according to claim 1, wherein the sensor is located in a combustion engine (6).

* * * * *